United States Patent [19]

Machnik

[11] 4,422,997

[45] Dec. 27, 1983

[54] METHOD FOR MAKING AN INSULATED PANEL

[76] Inventor: Alfred Machnik, 6386 Curtis Rd., Plymouth, Mich. 48170

[21] Appl. No.: 234,886

[22] Filed: Feb. 17, 1981

Related U.S. Application Data

[63] Continuation of Ser. No. 969,484, Dec. 14, 1978, abandoned.

[51] Int. Cl.[3] ..... B28B 1/50; B28B 1/30

[52] U.S. Cl. ..... 264/261; 264/274; 264/277

[58] Field of Search ..... 52/309.12, 577; 264/261, 275, 277, 274, 278, 333

[56] References Cited

U.S. PATENT DOCUMENTS

| | | | |
|---|---|---|---|
| 1,090,718 | 3/1914 | Hyer | 52/577 |
| 1,095,204 | 5/1914 | Golding | 52/577 |
| 2,266,510 | 12/1941 | Pottinger | 264/277 |
| 2,465,871 | 3/1949 | Hardie et al. | 264/277 |
| 2,572,580 | 10/1951 | Almroth et al. | 264/261 |
| 2,904,990 | 9/1959 | Emmerling | 52/392 |
| 3,192,567 | 7/1965 | Abernethy et al. | 264/261 |
| 3,512,327 | 5/1970 | Padura | 52/309.12 |
| 3,562,979 | 2/1971 | Ali-Oglu | 52/577 |
| 3,642,559 | 2/1972 | Stokes | 52/309.2 |
| 3,653,170 | 4/1972 | Sheckler | 52/309.12 |
| 3,689,121 | 9/1972 | Liester | 249/134 |
| 3,694,533 | 9/1972 | Kelsey | 264/277 |
| 3,826,052 | 7/1974 | Tenorio | 52/309.12 |
| 3,943,676 | 3/1976 | Ickes | 52/309.12 |
| 4,141,532 | 2/1979 | Wall | 249/134 |
| 4,229,497 | 10/1980 | Piazza | 52/309.12 |

FOREIGN PATENT DOCUMENTS

| | | | |
|---|---|---|---|
| 1966550 | 9/1973 | Fed. Rep. of Germany | 264/261 |

*Primary Examiner*—Willard E. Hoag

*Attorney, Agent, or Firm*—Charles L. Lovercheck; Wayne L. Lovercheck; Dale R. Lovercheck

[57] ABSTRACT

A process for forming wall modules wherein foam insulation blocks are supported in a frame and crossed nails are driven into said furring strips for supporting reinforcing rods and concrete which is poured between said blocks and said frame and the spaces between said blocks around the nails and reinforcing rods thereby holding the reinforcing rods in place until the concrete is poured around them and thereafter the nails hold the furring strips to the concrete module.

3 Claims, 14 Drawing Figures

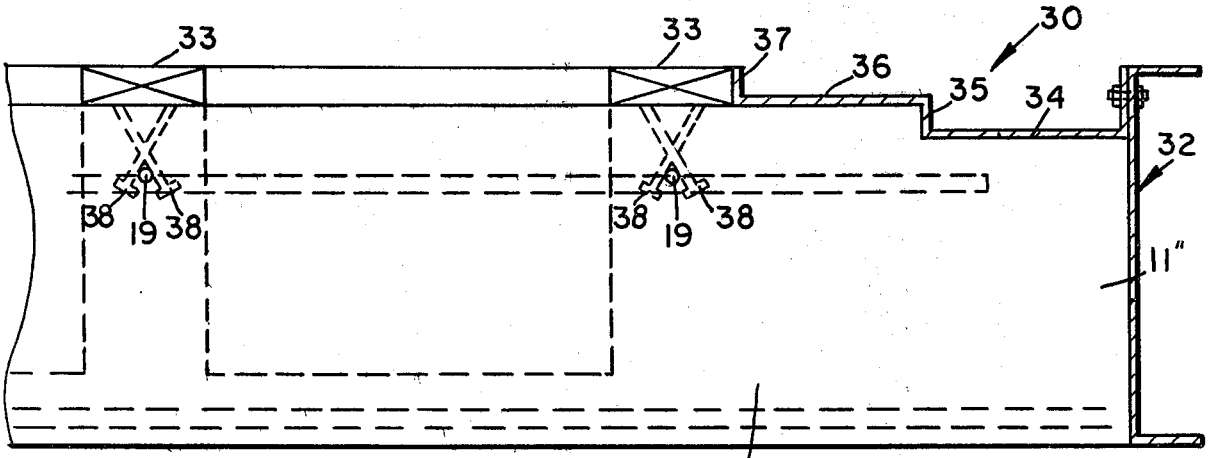
FIG 12
FIG 13
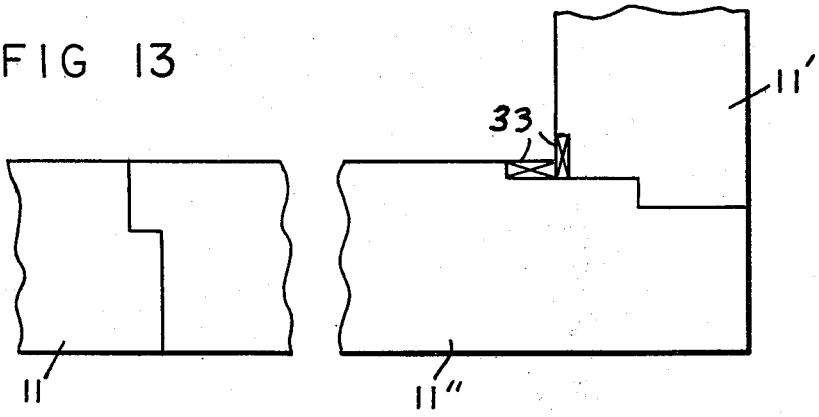
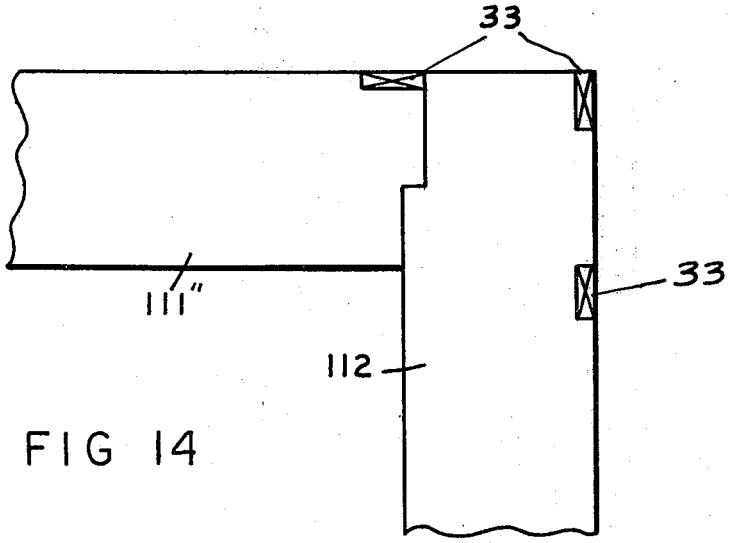
FIG 14

METHOD FOR MAKING AN INSULATED PANEL

GENERAL DESCRIPTION OF THE INVENTION

The application is a continuation of Ser. No. 969,484, filed Dec. 14, 1978, now abandoned.

The roundation disclosed herein is made up of side walls, end walls, each of the side walls and end walls are made up of a panel with reinforcing ribs and a top and bottom flange and end flanges and side flanges are provided with extra heavy interfitting joints, the lower edges of the panel are attached to a footer and the upper flanges support the plates and joists a building. Foam plastic is placed in the space between the flanges and the panel for insulation. The invention further provides a process for making the module wherein blocks of insulation are supported in a frame and concrete is poured around the blocks of insulation and around corssed nails in furring strips which hold the furring strips to the concrete after the concrete is poured.

OBJECTS OF THE INVENTION

It is the object of the invention to provide an improved wall panel.

Another object of the invention is to provide an improved insulated wall panel.

Another object of the invention is to provide a foundation made of interfitting insulated wall panels.

It is another object of the invention to provide an improved method of forming a wall module.

Another object of the invention is to provide a panel that is simple in construction, economical to manufacture and simple and efficient to use.

With the above and other objects in view, the present invention consists of the combination and arrangement of parts hereinafter more fully described, illustrated in the accompanying drawings and more particularly pointed out in the appended claims, it being understood that changes may be made in the form, size, proporations and minor details of construction without departing from the spirit or sacrificing any of the advantages of the invention.

GENERAL DESCRIPTION OF THE DRAWINGS

FIG. 12 is a top view of a form and module end to mate with the module of FIG. 11.

FIG. 13 is a partial end view of two modules made in the form according to the invention set up as an inside corner.

FIG. 14 is a partial end view of two modules according to the invention set up to form an outside corner.

DETAILED DESCRIPTION OF THE DRAWINGS

Figure 1:
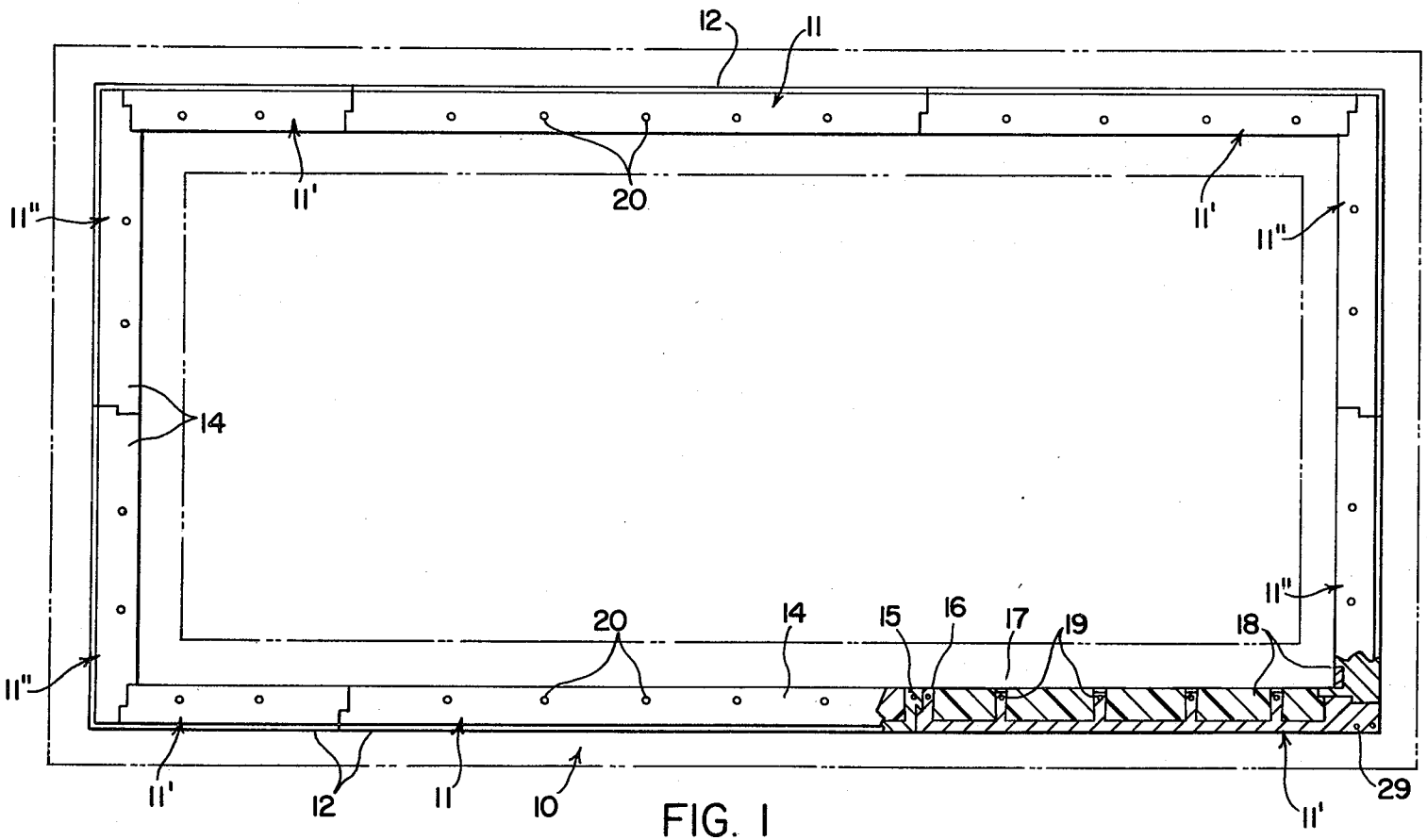
FIG. 1 is a plan view of a foundation according to the invention with the top plate removed.

Now, with more particular reference to the drawings, the foundation for a building is generally shown at 10 made up of wall modules 11 and corner modules 11' and 11''. The modules each are made up of a generally flat panel 12, the panel 12 having a bottom flange 13, top flange 14, end flanges 15 and 16 and intermediate flanges 17. Flanges 17 taper inward toward the panel and are thicker at the end remote from the panel and overlay a part of the frame material thereby holding it rigidly in place.

The top and bottom flanges 13 and 14, side flanges and end flanges 15 and 16 extend outwardly beyond the intermediate flanges 17 and foam plastic 18 deposited between the flanges outward to the level of the end flanges 15 and 16 and top and bottom 13 and 14. It will be noted that flanges 17 are tapered outwardly and are thicker at their end remote from side 12. This tapered end holds the foam plastic in place between the flanges and keeps it from moving outward. End flanges 15 are tapered for the same reason.

Longitudinal reinforcing rod 19 is placed in the flanges and threaded dowels 20 are inserted through the upper flange and lower flange and they project out from the top and are received in openings in plates 21. The headers 22 are attached to the outer edge of the plates 21 in the usual manner, and joists 23 rest on the plates 21 to form the usual construction of a house. Corners of the foundation are formed by panels 11' and 11'', which have heavy ends 24 and 25 which butt against each other and end 24 has an inner side that rests on the edge 26 of the second portion 27 while the end 28 rests in recess on the surface 20 of the outer corner of the panel. Vertical reinforcing rode 29 extend through the end flange members to give it additional strength. The reinforcing rod 30 is provided together with a bottom reinforcing rod.

Interlocking joints are formed by the end flanges 15 being offset adjacent the outside panel 11 and the end flanges 16 being offset at the end thereof remote from the panels 11.

Other reinforcements may be provided as desired.

Figure 2:
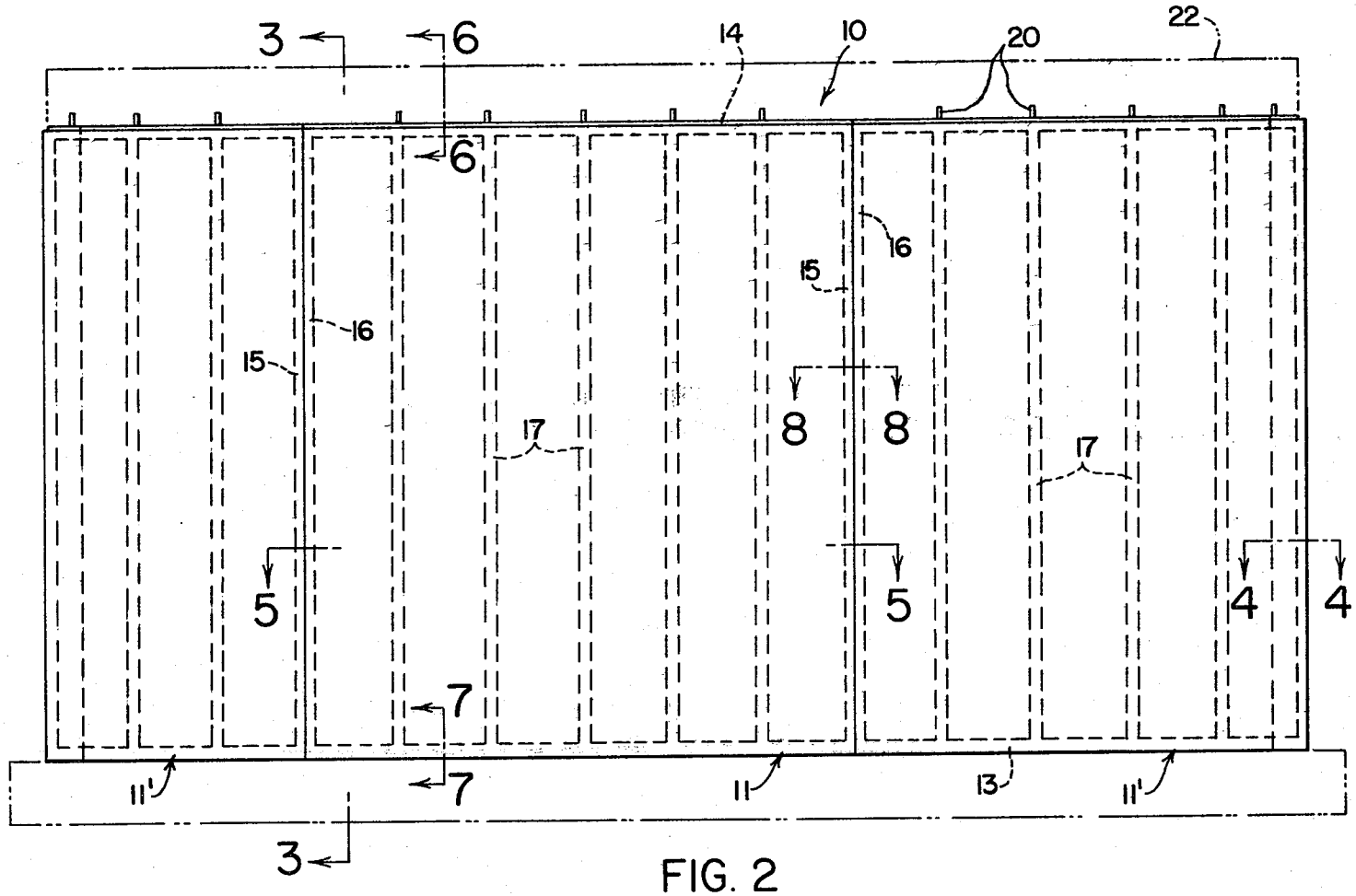
FIG. 2 is an elevational view from the outside face of the foundation of FIG. 1.
Figure 3:
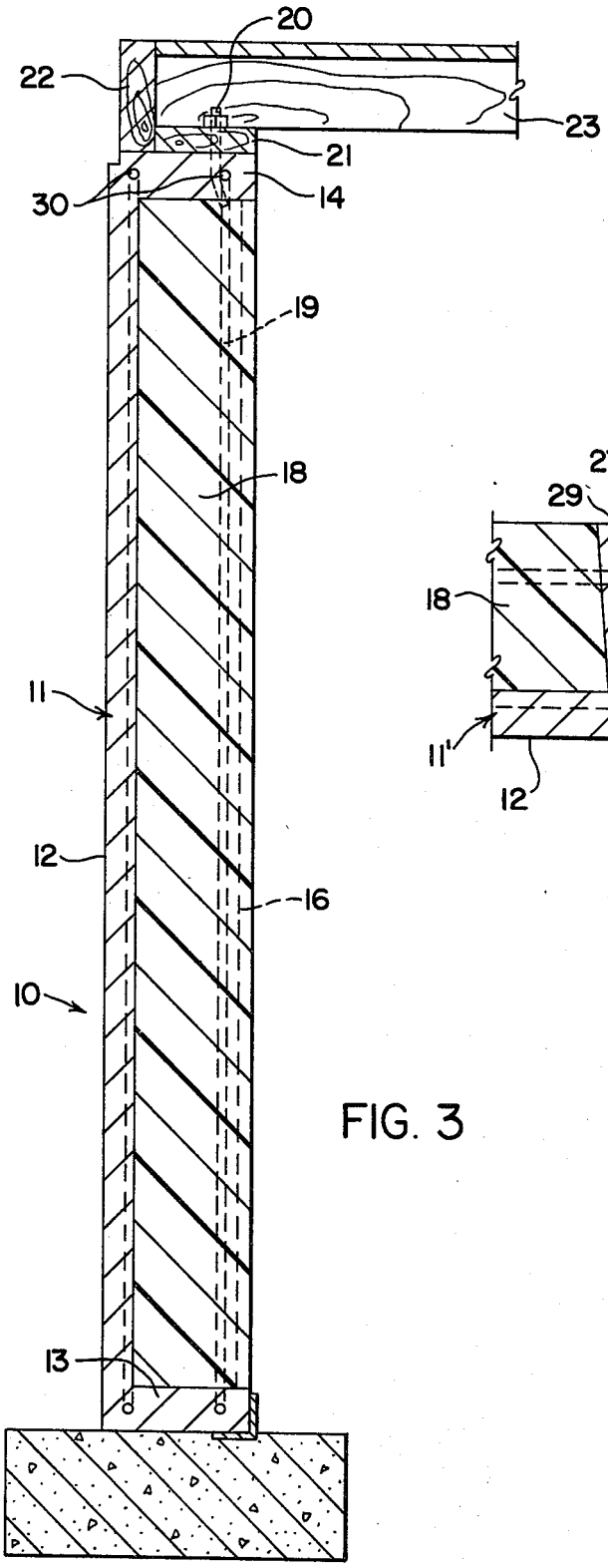
FIG. 3 is a cross-sectional view taken on Line 3—3 of FIG. 2.
Figure 4:
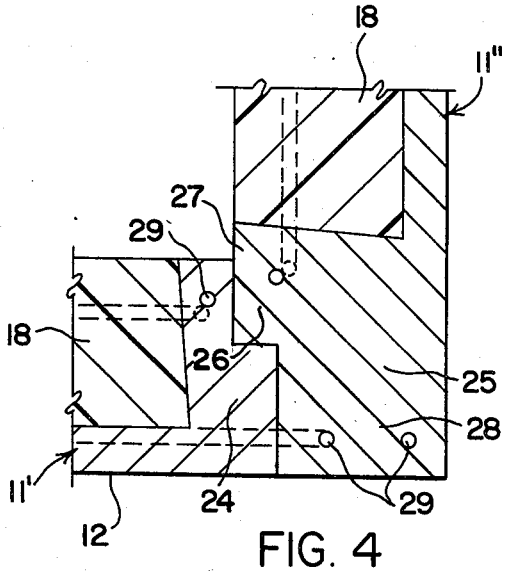
FIG. 4 is a cross-sectional view taken on Line 4—4 of FIG. 2.
Figure 5:
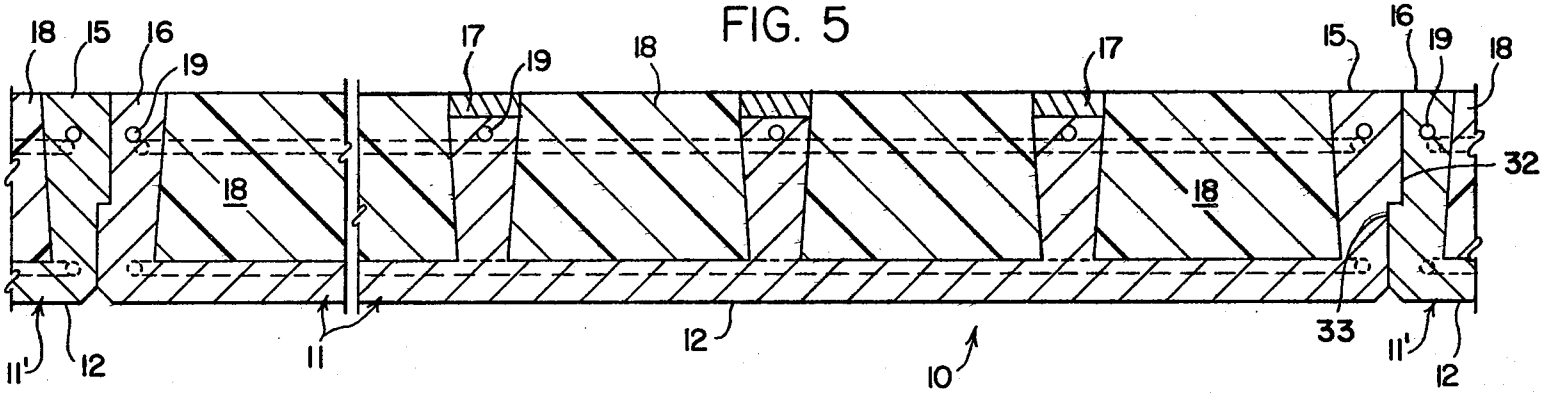
FIG. 5 is a cross-sectional view taken on Line 5—5 of FIG. 2.
Figure 8:
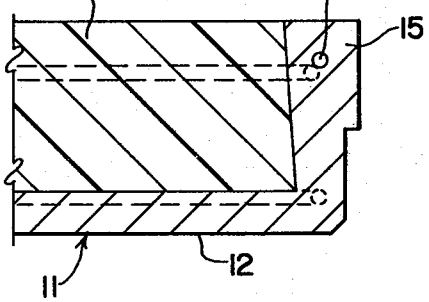
FIG. 8 is a cross-sectional view taken on Line 8—8 of FIG. 2.
Figure 7:
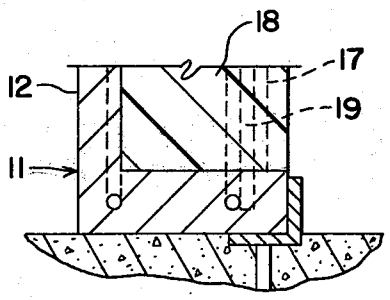
FIG. 7 is a cross-sectional view taken on Line 7—7 of FIG. 2.
Figure 6:
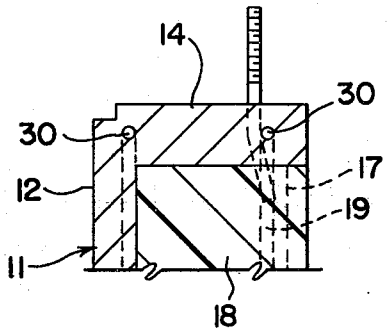
FIG. 6 is a cross-sectional view taken on Line 6—6 of FIG. 2.

The panels can be provided in modules of a convenient length, such as, for example, eight feet as indicated in FIGS. 1 and 2. The increments of the modules can be sixteen inches which is a standard dimension in building construction, and the centers of the flanges shown in FIG. 3 can be spaced on sixteen inch centers. When the modules are assembled in the foundation, the corners will be as shown in FIG. 4 and the interferring joints between modules will be as shown in FIGS. 4 and 1. The panels have outwardly extending projection 32 and 33 on their ends that interlock with flanges on the modules adjacent thereto.

Figure 9:
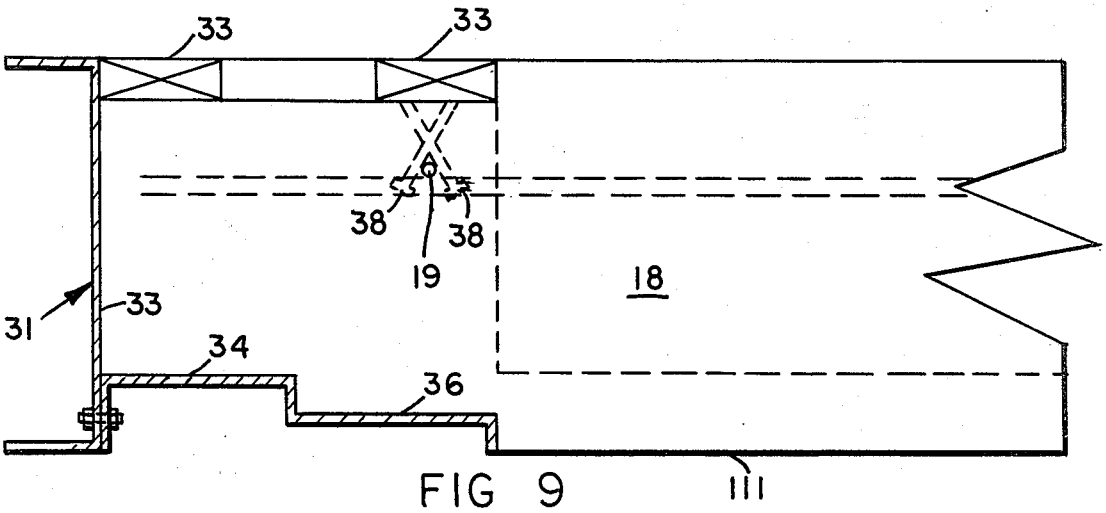
FIG. 9 is a top view of an end of a form and module therein for use as an outside corner to mate with the module end formed in FIG. 10.
Figure 10:
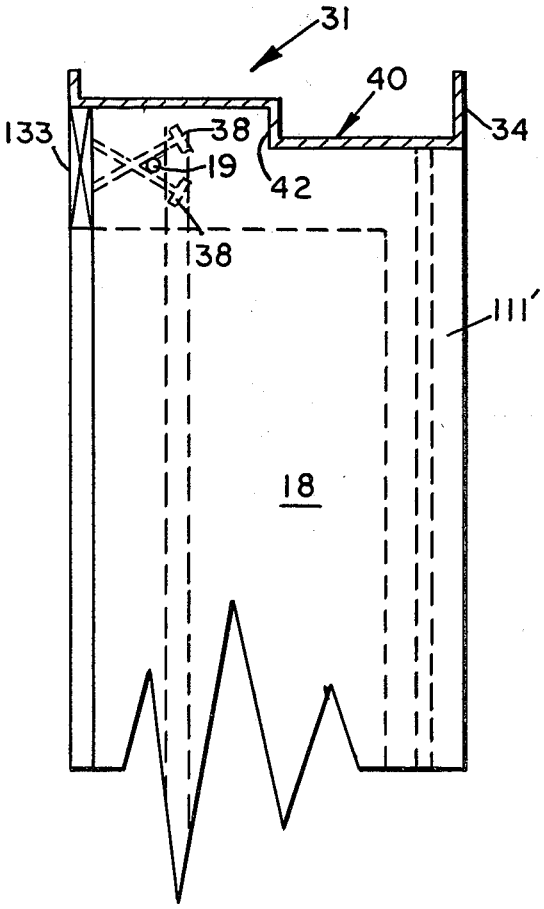
FIG. 10 is a top view of an end of a module formed to mate with FIG. 9.
Figure 11:
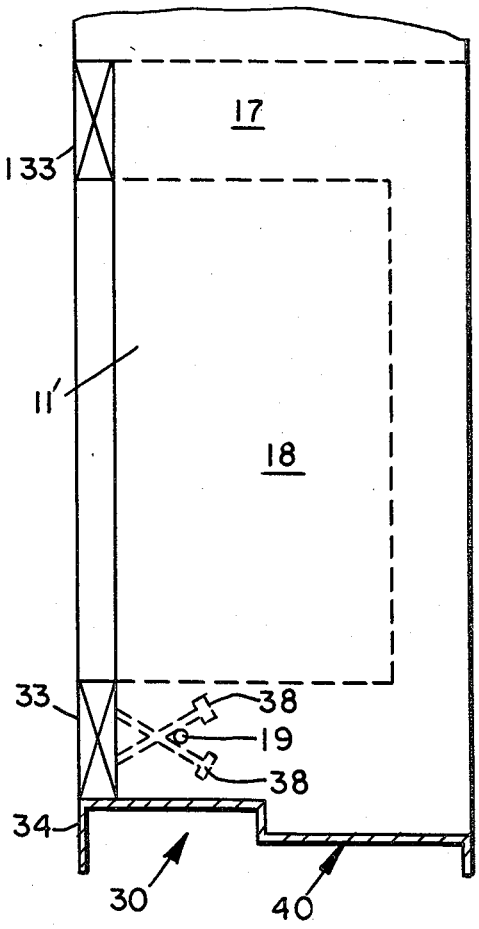
FIG. 11 is a top view of a form and module for making an inside corner.

Now, with more particular reference to the embodiments of the invention shown in FIG. 9, I show a form 110 with end flanges. Forms 30 and 31 which are shown are made of steel but could be made of wood planks or any other suitable material. Form 30 is intended to make modules to interfit with modules made in either form 30 or other modules made in form 31. By reversing forms 30 and 31 from the positions shown in the partial views of FIGS. 9–12, modules can be made to form either inside or outside corners, as shown in FIG. 9 and FIG. 11.

To use the forms, the forms are supported on any flat surface, such as a floor, and nails 38 are driven into the furring strip 33 from the top either before the furring strips are placed or after, the reinforcing rods 19 are placed in the cradles formed by the crossed nails 38. The foam plastic insulation blocks 18 are then put into the form leaving spaces for concrete to form webs 17. The blocks 18 are thinner than the wall, leaving space for webs. Concrete is then poured into the form over and around the insulation blocks 18 and into the spaces between the insulation blocks to form flanges 19 and the ends of the panels. The ends of module 11''' mate with the end of module 11 to form an outside corner so that the furring strips 33 are on one side of the corner and the other furring strips 33 are on the other side of the corner.

The forms have sides that are made up of flat plate-like members or they could be steel channel members like channel members 33' shown in FIG. 9. These channels members would extend along the top and the bottom of the panel to be formed.

In the embodiments shown in FIG. 9 and FIG. 12, the forms for the ends of the module are in the form of a plate-like member 33' which could be a plank, or it could be a channel member as shown in FIGS. 9 and 12. Channel member has the bracket having legs 34 and 35 and leg 36 attached to its one side. This bracket has the legs 34 and 36 connected by a leg 35, and it forms the shape of the side of the module adjacent the end so that the corner shown in FIG. 13 can be formed by resting an end of a module 111'' on it. The corner receives the furring strips 33 which are placed adjacent the leg 37 of the member 30, and the other furring strips 33 are located as shown between the blocks of insulation 18. The nails 38 are driven into the furring strips in cross relation as shown, and when the furring strips are laid on a flat surface, the reinforcing rods 19 can be supported in the cradle formed by the nails. Thus, to carry out the invention, the forms are laid on a flat surface with one side or the other up, depending on whether the module is to be an inside corner, an outside corner or an intermediate panel, whether a module 11, 11' and 11'' or module 111 and 111'' are to be made. The blocks of insulation 18 which will be of lesser depth than the depth of the forms are put in place, and furring strips 33 or 133 are placed between the blocks of insulation so that they will end up on the inner ends of the flanges of the module. Reinforcing rod 19 is placed in the cradles formed by nails 38, and concrete is poured around the insulation 18, over the reinforcing rod 19 and over nails 38. When the concrete has set, the nails 38 will be imbedded in the concrete and will hold the furring strips in place and will also act as supports for the reinforcing rod 19 during the time that the concrete is being placed. The furring strips will be on the surface of the modules to the inside of the building in the proper position for applying finish material, and will be held in place by the nails, and they will be adjacent the ends of the modules and at intermediate parts along the module as shown.

The foregoing specification sets forth the invention in its preferred, practical forms, but the structure shown is capable of modification within a range of equivalents without departing from the invention which is to be understood is broadly novel as is commensurate with the appended claims.

The embodiments of the invention in which an exclusive property or privilege is claimed are defined as follows:

1. A process for making a building module 110 comprising, providing a frame having sides, ends and an open top, forming an enclosure having inside dimensions equal to the dimensions of said module to be formed comprising, placing said frame on a relatively horizontal flat surface, placing blocks of insulation material in said frame spaced from each other a sufficient distance to provide spaces for concrete to form webs and spaced inwardly from the edges of said frame to receive concrete, forming sides, placing furring strips in said frame in the spaces between said insulation blocks and resting on the flat surface forming the bottom of said frame, the furring strips resting on said flat surface, said furring strips having nails driven from the side opposite said flat surface therein, said nails being crossed forming a cradle to receive reinforcing rods, supporting the reinforcing rods in said cradle spaced at a distance from said furring strips and pouring concrete into the space between said frame and around said reinforcing rods and around said nails and between said insulation blocks and said frame whereby an insulation panel is formed with concrete between and around said insulation material.

2. The process recited in claim 1 wherein one furring strip disposed adjacent one end of said frame and said end of said frame has an offset flange bottom therein forming recesses in the poured concrete for receiving an end of a said panel.

3. The process recited in claim 2 wherein said blocks of insulation material having inclined edges inclined from the surface to be disposed adjacent on inside wall away from one another.

* * * * *